United States Patent [19]

Hirst et al.

[11] 4,160,302

[45] Jul. 10, 1979

[54] REFUSE COLLECTING VEHICLES

[75] Inventors: Peter B. Hirst, Billingshurst; Anthony J. Duthie, Horsham, both of England

[73] Assignee: Johnston Brothers (Engineering) Limited, Redhill, England

[21] Appl. No.: 852,527

[22] Filed: Nov. 17, 1977

[30] Foreign Application Priority Data

Nov. 18, 1976 [GB] United Kingdom ..... 48226/76

[51] Int. Cl.[2] ..... A47L 9/00

[52] U.S. Cl. ..... 15/340; 15/87; 15/347; 55/419; 55/447

[58] Field of Search ..... 15/87, 340, 347; 55/385 B, 419, 447, 462

[56] References Cited

U.S. PATENT DOCUMENTS

| | | | |
|---|---|---|---|
| 3,790,981 | 2/1974 | Young | 15/340 X |
| 3,847,293 | 11/1974 | Boon | 15/340 X |
| 3,886,623 | 6/1975 | Landesman et al. | 15/340 X |

FOREIGN PATENT DOCUMENTS

| | | | |
|---|---|---|---|
| 2030150 | 1/1971 | Fed. Rep. of Germany | 15/340 |

*Primary Examiner*—Christopher K. Moore
*Attorney, Agent, or Firm*—Young & Thompson

[57] ABSTRACT

A vacuum operated refuse collecting vehicle includes an air-tight container mounted on the chassis of the vehicle and having an outlet communicating with means for generating a vacuum within the container. A suction conduit is provided for each side of the vehicle, each suction conduit extending at one end into the interior of the container and being provided at the other end with a nozzle which may be disposed at a short distance from the ground. Brrush means are provided. Means are mouned at said one end of each conduit which are operable from outside the container, for separately closing off said one end of each suction conduit to prevent refuse entering said one end of the conduit when it is closed. Said one ends of said suction conduits communicate with the container in positions one on each side of a central longitudinal plane of the container and adjacent one end of the container. Said outlet is positioned in the upper part of the container adjacent the other end of the container and continuously curved deflector means are provided above said one end of each suction conduit. The arrangement is such that, in use, with one suction conduit open and the other closed, air entering the container through said one of the suction conduits is diverted by the respective deflector means up around the upper part of the container and down towards the central lower part of the container before passing out through the outlet, to prevent refuse being deposited on and around said one end of said other suction conduit.

19 Claims, 19 Drawing Figures

REFUSE COLLECTING VEHICLES

BACKGROUND OF THE INVENTION (i) Field of the Invention

The invention relates to vacuum operated refuse collecting vehicles and more particularly to vacuum operated refused collecting vehicles of the kind comprising an air-tight container mounted on the chassis of the vehicle and having an outlet communicating with means for generating a vacuum within the container and a suction conduit for each side of the vehicle, each suction conduit extending at one end into the interior of the container and being provided at the other end with a nozzle which may be disposed at a short distance from the ground.

(ii) Prior Art

Known refuse collecting vehicles of the kind described above generally are designed so that the container is approximately centrally positioned over the rear axle of the vehicle chassis and the container is usually pivoted about a transverse pivotal hinge at its rear so that the container may be tipped up to discharge its contents by gravity. An openable rear door is provided in the container for this purpose.

In normal use of the vehicle, one of the suction conduits is closed off and the vacuum generating means induces a fast flowing airstream through the other suction conduit which sucks refuse into the container.

Various arrangements for the suction conduit inlets to the container, the means to close them off and the suction outlet from the container have been proposed. In one known arrangement, the inlets from the suction conduits are positioned towards the front of the container in its lower part and the outlet is at the rear upper part of the container. In this arrangement, the interior upper wall of the container is concavely curved so that the refuse laden airstream entering via the suction conduit which is in use flows up one side of the container, around the top and down the other side, thence eventually to the outlet. This has the disadvantage that refuse carried by the air stream tends to be deposited at the side of the container opposite to the inlet in use, on and around the suction conduit which is not in use. This deposit of refuse results in uneven loading of the container and further may result in the suction conduit which is not in use becoming blocked by the pile of refuse. This problem is compounded by the fact that the spare suction conduit in such machines is usually closed off by a blanking plate inserted in the suction conduit at a point intermediate its ends so that the end of the conduit projecting into the container may become filled with refuse.

In other known arrangements, blanking plates for the suction conduits are provided which are slidably or pivotally mounted at the end of the respective suction conduit projecting into the container and thus prevent refuse from entering the spare suction conduit during operation of the vehicle. However, in these other known arrangements, the outlet from the container consists of an orifice extending along the centre line of the upper part of the container and this has the disadvantage that refuse-laden air entering the container through the suction conduit which is in use, tends to pass directly to the outlet. This is unsatisfactory because it is essential for the effective operation of vacuum operated refuse collecting vehicles of this type that the refuse laden air stream is induced to travel through the maximum distance possible within the container so that expansion and slowing down of the air stream allows the refuse to drop out of the air stream before the air reaches the outlet from the container. Attempts have been made to introduce baffles into vehicles having this last-described arrangement in order to divert the incoming air stream away from the outlet but none of these attempts has been very successful.

SUMMARY OF THE INVENTION

The present invention seeks to overcome or at least significantly reduce the problems described above and provides a vacuum operated refuse collecting vehicle comprising in combination an air-tight container mounted on the chassis of the vehicle and having an outlet communicating with means for generating a vacuum within the container, a suction conduit for each side of the vehicle each suction conduit extending at one end into the interior of the container and being provided at the other end with a nozzle which may be disposed at a short distance from the ground, brush means and means mounted at said one end of each conduit and operable from outside the container for separately closing off said one end of each suction conduit to prevent refuse entering said one end of the conduit when it is closed, in which said one ends of said suction conduits communicate with the container in positions one on each side of a central longitudinal plane of the container and adjacent one end of the container, said outlet is positioned in the upper part of the container adjacent the other end of the container and continuously curved deflector means are provided above said one end of each suction conduit, the arrangement being such that, in use, with one suction conduit open and the other closed, air entering the container through said one of the suction conduits is diverted by the respective deflector means up around the upper part of the container and down towards the central lower part of the container before passing out through the outlet, to prevent refuse being deposited on and around said one end of said other suction conduit.

DESCRIPTION OF THE PREFERRED EMBODIMENT

Figure 1:
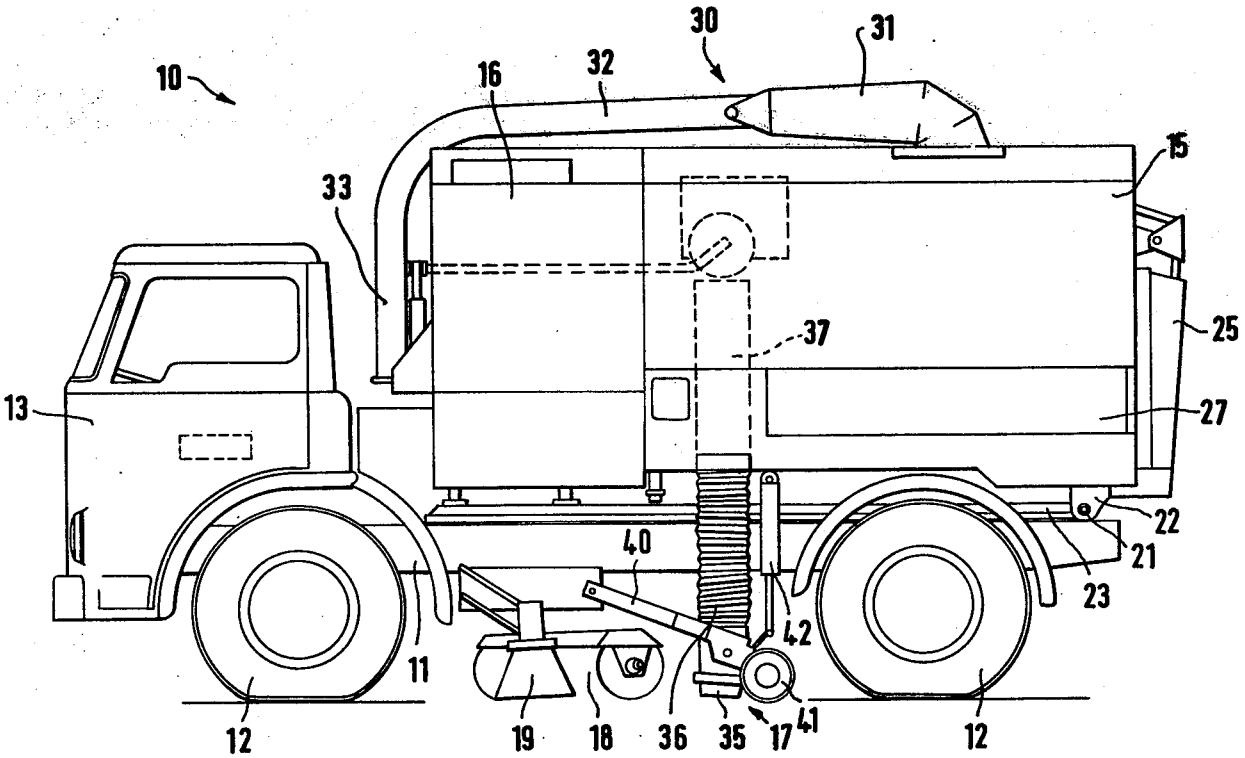
FIG. 1 is a schematic elevation of a road sweeping vehicle according to the invention.

Referring first to FIG. 1, a dual sweep suction road sweeping vehicle 10 comprises a self-propelled chassis 11 including road wheels 12 and a driver's cab 13, on which are mounted a tipping body 15, a fan housing 16, suction equipment 17, a wide sweep brush 18 and a pair of channel brushes 19, one located on either side of the vehicle.

The tipping body 15 is an all steel welded monocoque assembly which is pivotable about a horizontal axis 21 adjacent its rear end. The body is mounted on a subframe comprising steel members 23 to which the body is pivotally attached by means of flanges 22 depending from the body. The interior of the tipping body, which will be described in more detail below, provides an air-tight container for dust etc. swept up by the vehicle and is closed off by a rear door 25. As can be seen in FIG. 1, the rear door is pivoted about its upper edge and is operable by a ram (not shown) in known manner to permit egress of material contained in the body when the body is tipped. A further ram (not shown) connected between the front part of the tipping body 15 and the subframe 23 is operable to tip the body.

Integral with the tipping body and closed off by doors which are flush with the external surface of the body are tool lockers 27, hose trays and other standard lockers of the type normally found on suction road sweeping vehicles in which the lockers and hose trays are normally of the "bolt-on" type. The provision of these lockers integral with the tipping body allows a design of body 15 which is symmetrical about a central longitudinal plane and has no external protrusions, in contrast with known road sweeping vehicles in which the lockers are of the "bolt-on" type.

Protruding from the top of the tipping body 15 is a wandering hose 30 comprising a first section 31 which communicates with the interior of the body 15 and is pivotable about a vertical axis. Hingedly connected to the first section 31 is a second hose section 32 which is L-shaped so that a nozzle 33 of the wandering hose may be brought adjacent to the ground by pivotal and hinging movement of the wandering hose.

Figures 9, 10, 10A:
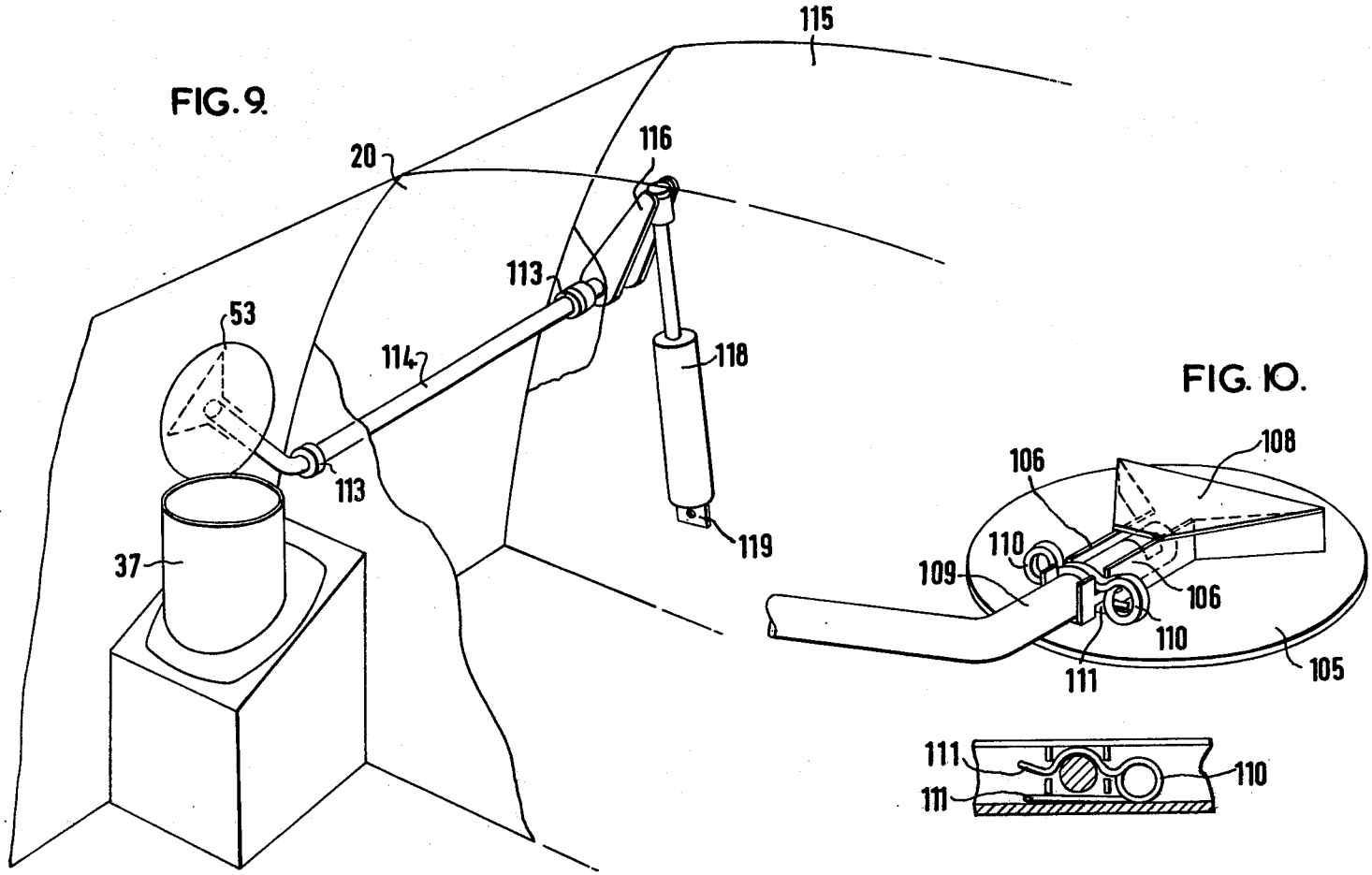
FIG. 9 is a diagrammatic perspective view of part of the interior of the vehicle body, showing the intake flaps.
FIG. 10 is an enlarged detail of one of the intake flaps.
FIG. 10A is a fragmentary cross-sectional view of a portion of FIG. 10.

The fan housing 16 extends from the front of the tipping body 15 to which it is rigidly connected and from which it is divided by a partition 20 (FIG. 9). The housing 16 encloses, when in the position shown in FIG. 1, an engine and suction fan which are mounted on the subframe 23 and apply suction to the interior of the tipping body when the vehicle is sweeping as will be described below. The ancillary hydraulic equipment, fuel tanks, etc., for the sweeping equipment are also mounted on the subframe within the housing 16.

The subframe is rigidly mounted on the chassis 11 which may be any suitable type of vehicle chassis, provided with dual driving controls in the cab 13.

The suction equipment 17 comprises, on each side of the vehicle 10, a nozzle 35 connected by a flexible pipe 36 to an inlet duct 37 into the body 15. There is a suitable make-and-break connection between each pipe 36 and duct 37 to allow the body to be tipped. Each nozzle 35 is arranged behind the corresponding channel brush 19 and in front of the rear wheels 12. The nozzle 35 is pivoted on a draw bar 40 the free end of which is supported by wheels 41 which control the height of the nozzle 35 above the road surface. Each nozzle 35 and wheel 41 assembly may be lifted clear of the road by a ram 42 and the assembly is so lifted except when the vehicle is sweeping using the channel brush 19 on the same side as the said nozzle.

Figure 2:
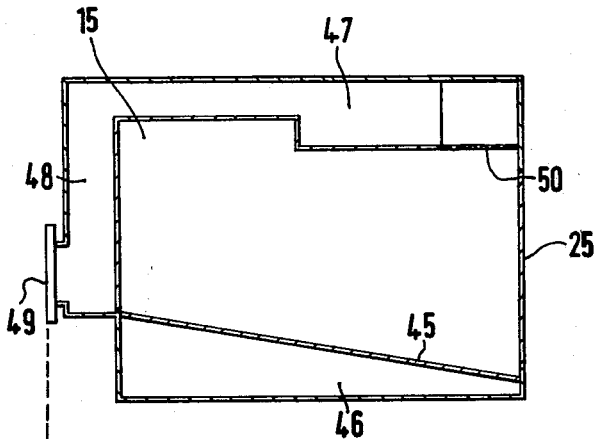
FIG. 2 is a schematic longitudinal section through the body of the road sweeping vehicle.
Figure 3:
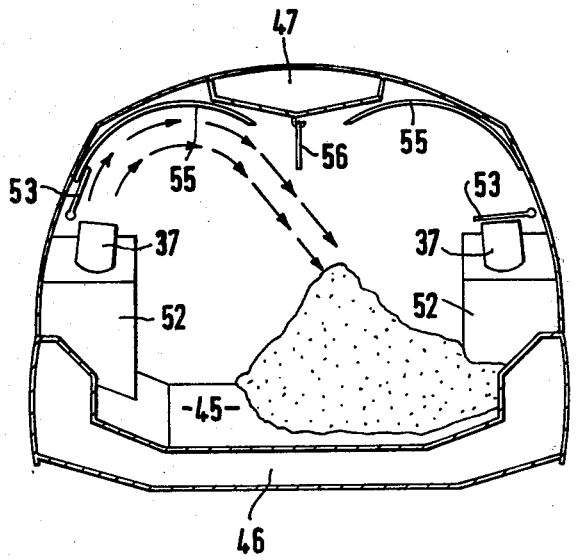
FIG. 3 is a schematic transverse section through the body.
Figure 4:
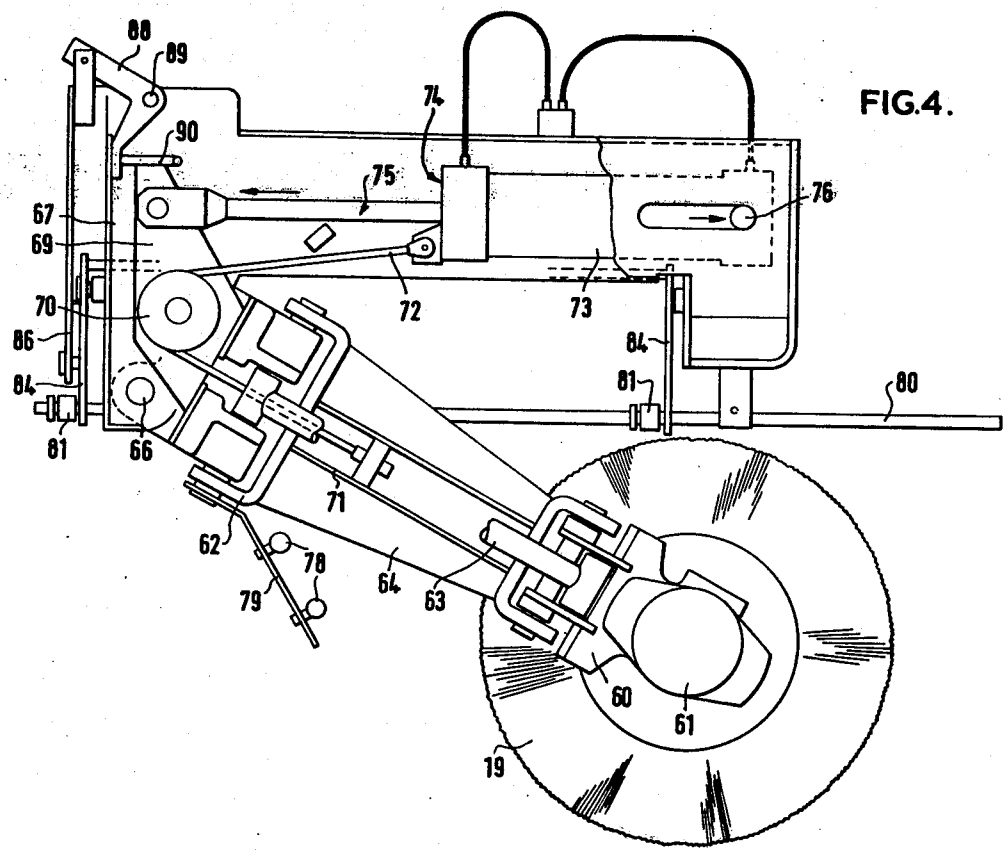
FIG. 4 is a plan view showing the channel brush in the retracted position.

The interior of the body 15 will now be described with reference to FIGS. 2 and 3. As can be seen particularly in FIG. 2, a sloping floor 45 is provided in the body to partition off a lower part of the body which forms a water tank 46. The central upper part of the body is also partitioned off to form a duct 46 connected by another duct 48 to a flanged connector 49 which is connected to the inlet side of the suction fan when the body is in its lowered position as shown in FIG. 1. The duct 47 is flared at its end adjacent the rear of the body and the rearmost portion is formed by a mesh grill 50 which extends across the full width of the body at the position shown.

Extending upwardly into the body at either side and adjacent its front end are the inlet ducts 37, which form a substantially straight extension of the nozzles 35 and pipes 36.

Each inlet duct is boxed in by a housing 52 to facilitate clearing of the interior of the body and ensure no build up of swept material between the duct 37 and the adjacent walls of the body 15. The inlet ducts 37 are alternately closed off by flaps 53 which will be described in more detail below with reference to FIGS. 9 and 10. Arranged above the ducts 37 are curved wear plates or baffles 55 which are bolted to the side of the body shell. The wear plates, which are identical, each extend to a position adjacent the median plane of the body and suspended at this median plane is a further plate or baffle 56.

The baffles are so arranged that dust and other material swept up by the machine is more evenly distributed within the body that has been the case in the past and as will be described below. FIG. 3 diagrammatically illustrates the ingress of refuse (as defined above) into the body.

Turning now to FIGS. 4 to 7, a more detailed description of a channel brush 19 and its associated equipment will be given. The left hand side channel brush 19 is illustrated in FIGS. 4 to 7 but it will be realised that the description applies equally to the right hand brush.

The channel brush 19 is mounted on a bracket 60 and is driven by a hydraulic motor 61 also mounted on the bracket 60. The bracket 60 is connected to a second bracket 62 by a pair of pivotal links 63,64, the upper one of which 63 has an adjustable sliding connection 65 with the bracket 60 to permit adjustment of the angle of the brush 19 relative to the ground. The second bracket 62 is mounted on a vertical pivot 66 which is rigidly supported on a framework 67 which is in turn attached to the chassis 11.

Extending from the bracket 62 and rigidly secured thereto are a pair of plates 69 between which is rotatably mounted a pulley 70. A cable 72 attached at one end to a pair of flanges 71 upstanding from the lower link 64, passes around the pulley 70 and is attached at its other end to the cylinder 73 of a pneumatic ram 74. The cylinder 73 is slidably connected at 76 to another portion of the framework 67 and its piston 75 is pivoted to the plates 69.

Figure 5:
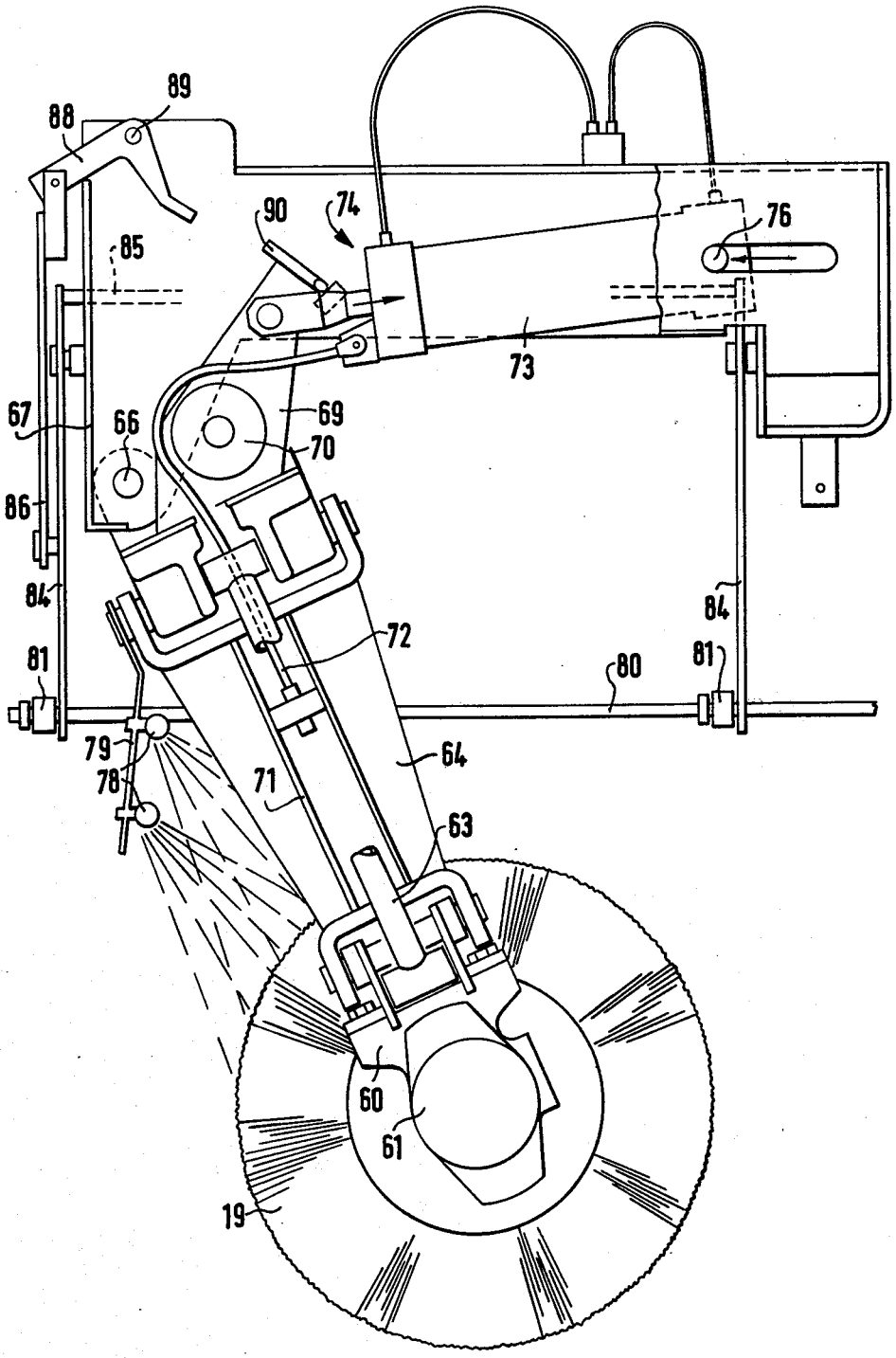
FIG. 5 is a view similar to FIG. 4 showing the channel brush in its working position.
Figure 6:
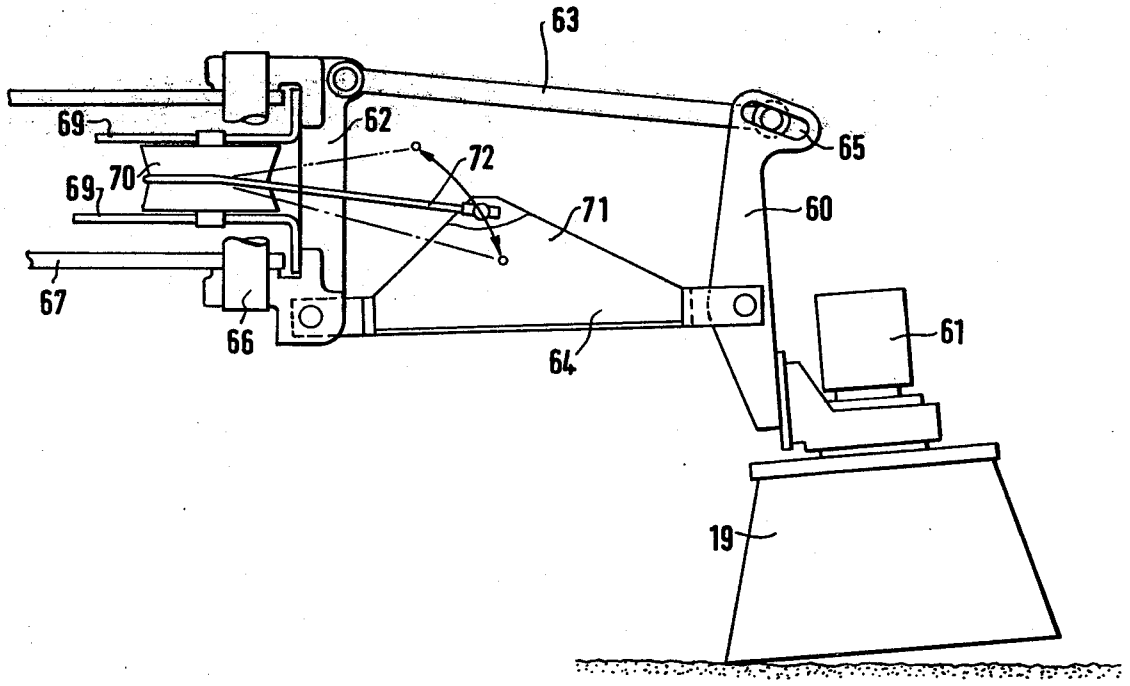
FIG. 6 is a side elevation showing the channel brush in its working position.
Figure 7:
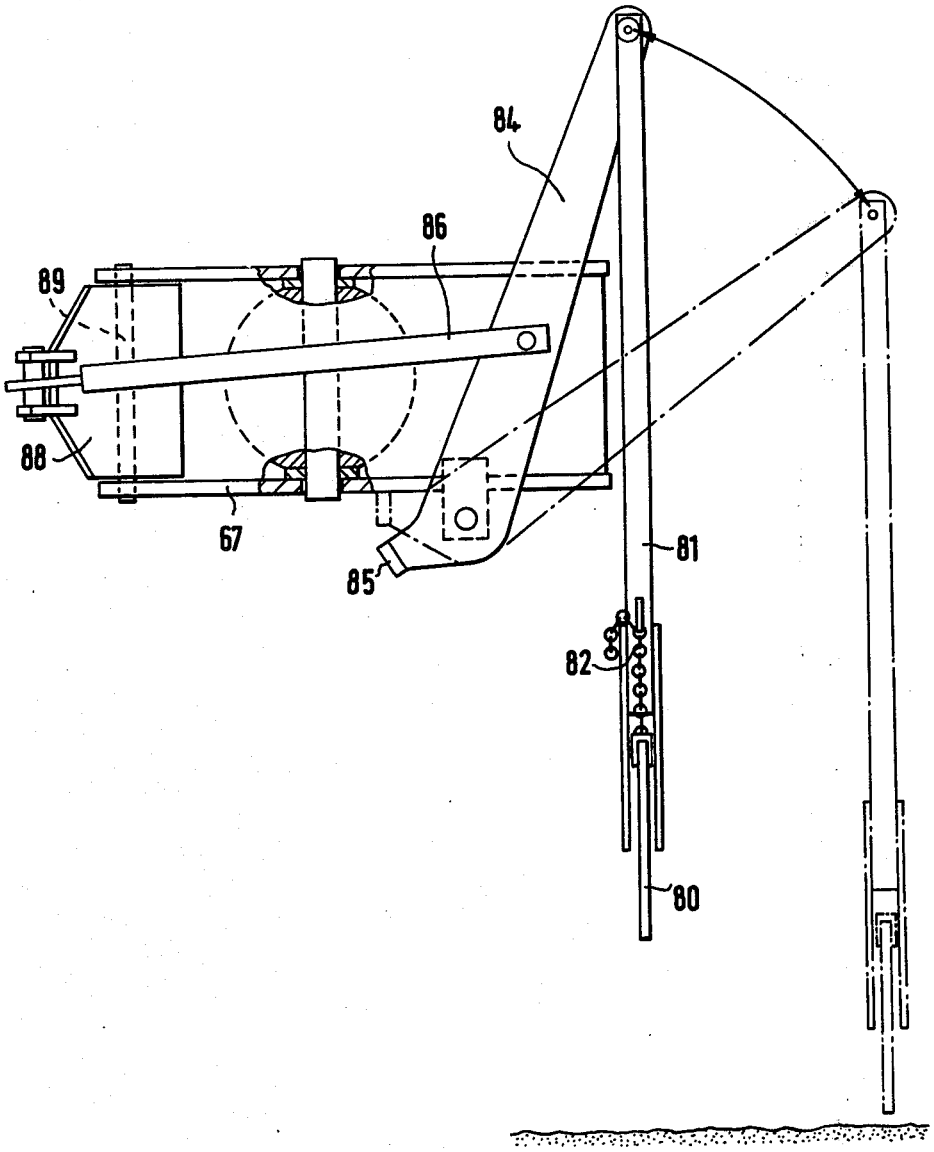
FIG. 7 is an end elevation showing the channel brush curtain, looking in the direction of arrow 7 in FIG. 5.

FIGS. 5 and 6 show the brush 19 in its lowered operating position in which the ram 74 is contracted to allow the cable 72 to be slack and the brush to float on the ground. Pressure is maintained in the ram 74 during operation of the brush in order to provide a cushion for the brush against which it may react on contact with a pavement or like obstacle.

Nozzles 78 are provided on a bracket 79 attached to bracket 62 and spray water towards the brush 19 during operation as shown in FIG. 5.

When the brush 19 is not in use it is retracted by pressurisation and thus extension of ram 74 to tighten the cable 72. Tightening of the cable causes the brush 19 to be lifted clear of the ground and simultaneously swung inwardly of the vehicle to the position illustrated in FIG. 4. The sliding connection 76 of the cylinder 73 to the framework 67 allows a freedom of movement of the cylinder which ensures that the brush is lifted upwardly and inwardly in a smooth operation.

A curtain assembly (FIG. 7) is provided on the inboard side of each brush 19 to control the sweepings and ensure that they remain in the path of the suction nozzle 35. The curtain assembly comprises a flexible curtain 80 suspended from a pair of support arms 81. The curtain is attached to the support arm by chains 82 so that it may be adjusted in a up-and-down direction relative to the arms. Each support arm 81 is pivoted at its upper end to a davit 84 pivoted on the framework 67 and the two davits 84 are rigidly connected together by a relay rod 85. An operating link 86 connects one of the davits 84 to an operating lever 88 which is pivotally attached at 89 to a portion of the framework 67.

The operating lever 88 is actuated by a finger 90 (see FIG. 5) rigidly attached to the end of plate 69 remote from bracket 62. The extension and contraction of ram 74 moves the finger 90 between the positions shown in FIGS. 4 and 5. In FIG. 5 the finger is out of contact with the operating lever 88 and the curtain descends downwardly and outwardly to the position shown in FIG. 5 and by chain dot lines in FIG. 7. The limit of this movement is controlled by the relay rod 85 coming into contact with framework 67. As the ram 74 is extended towards the position shown in FIG. 4, the finger 90 contacts operating lever 88 and pivots it thus lifting the curtain 80 upwardly and inwardly to the position shown in FIG. 4 and in solid lines in FIG. 7.

Figure 8:
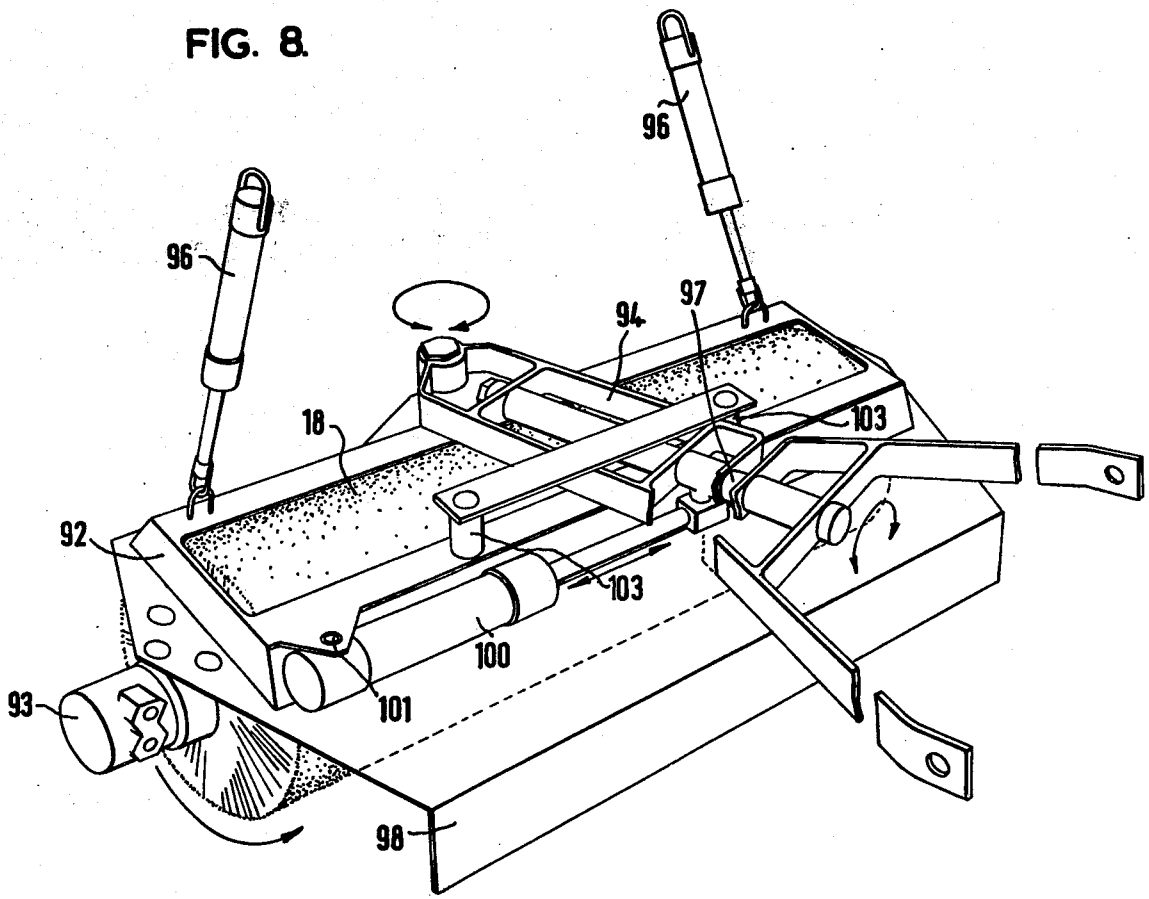
FIG. 8 is a perspective view of the wide sweep brush.

Turning now to FIG. 8, the wide sweep brush 18 is mounted for rotation about a horizontal axis on a frame 92 and is driven by a hydraulic motor 93. The frame 92 is pivotally attached to one end of a tow bar assembly 94 and is suspended from the vehicle chassis 11 by means of two pneumatic rams 96, which are operable to raise the wide sweep brush off the ground when it is not in use. The other end of the tow bar assembly 94 is pivoted to the chassis forwardly of the rams 96, and the tow bar includes a swivel bearing 97 to permit transverse tilting of the brush 18.

A curtain 98 is attached to the leading edge of the frame 92 to control the sweepings and the brush may be angled to left or right by a hydraulic ram 100 connected between a trunnion 101 on the frame 92 and the tow bar assembly 94. Stops 103 limit the angling of the brush 18, and this limit angle is preselected to optimise the throw of the material swept up by the wide sweep brush 18 into the path of the appropriate suction nozzle 35.

FIG. 9 shows in more detail the left hand one of the flaps 53 which close off the inlet ducts 37. The flap 53 comprises a circular plate 105 of hardened steel to the upper surface of which are welded a pair of guides 106 which are flared at one end and support a trapezoidal pad 108. Located between the guides 106 is an actuating finger 109 which is retained assembled with the guides by a pair of opposed spring clips 110 and extends between the guides with its end projecting beneath the pad 108. The said end is to some extent rounded. Each spring clip 110 has the shape shown in the enlarged detail of FIG. 10 and locates in slots 111 formed in the guides and a groove formed in the actuating finger 109. The arrangement of the finger 109 and its attachment to the plate 105 are such that the plate can pivot relative to the finger so that it will seat on and seal the duct 37 even if the height of the end of the duct relative to the finger 109 is incorrect. The actuating finger 109 is rigidly attached to an actuating shaft 114 which extends through the fan housing 16 and is supported by bearings 113 at the partition 20 and at the front wall 115 of the housing 16. An actuating lever 116 is rigidly secured to the end of the shaft 114 protruding from the housing 16 and is pivoted to the piston of a pneumatic ram 118 supported on a trunnion 119. The ram 118 is operable to move the flap 53 between a first position in which the flap 53 closes off the intake duct 37 and a second position, as shown in FIG. 9 in which the pad 108 bears on the inside surface of the body 15 and the flap 53 acts as an additional wear plate above the intake duct.

It will be realised that the vehicle described above is designed for sweeping on the left or right hand side of the vehicle and for one particular side only certain parts of the sweeping equipment are in operation. Thus, for left hand side sweeping, the left hand channel brush 19 is lowered, the water spray nozzles 78 on that brush are switched on, the suction nozzle 35 on that side is lowered, the wide sweep brush 18 is angled towards the left, the left hand flap 53 is open and the right hand flap 53 is closed. Further water spray nozzles for the wide sweep brush 122, the left hand gutter 123 and the left hand suction nozzle 124 are also switched on. These nozzles 122, 123, 124 are shown diagrammatically in FIG. 11.

During right hand side sweeping, the complementary brushes, nozzles etc. operate and when the vehicle is not sweeping, the channel 19 and wide sweep 18 brushes and the suction nozzles 35 are raised clear of the ground and the water spray nozzles 78, 122, 123, 124 are all switched off.

Figure 11:
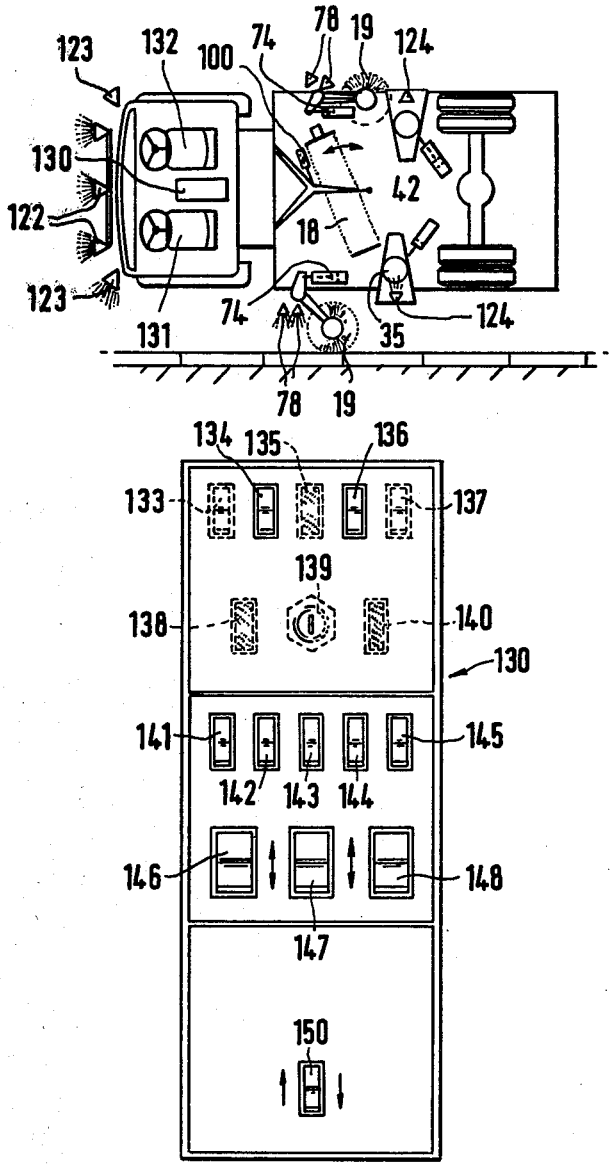
FIG. 11 is a plan view of the control console showing schematically the control functions.

To change the vehicle equipment between left hand, right hand and non-sweeping modes, it is necessary to operate the various pneumatic and hydraulic rams etc. and these operations are all controlled by the operator of the vehicle from inside the cab 13. The various controls for the sweeping equipment are all sited on a control panel 130 situated in the centre of the cab between the left and right hand driving positions 131, 132 respectively (FIG. 11). The controls sited on the panel 130 are as follows. Three warning lights 135, 138 and 140 indicate respectively excessive weight load, low oil pressure in the auxiliary engine and high coolant water temperature in the auxiliary engine. An ignition switch 139 turns on the auxiliary engine for driving the fan. The upper section of the control panel is completed by switches 134, 136 which open and close the left hand flap 53 and right hand flap 53 respectively, a switch 137 which turns on a warning beacon (not shown) fitted to the roof of the vehicle and a spare switch 133.

The central section of the control panel 130 contains switches which control the sweeping gear. A row of five on-off switches 141–145 control the water spray jets, the switches respectively controlling reading from left to right nozzle jets 124, gutter jets 123, two for channel brush jets 78 and wide sweep jets 122. Three larger rocker switches 146, 147 and 148 control the raising and lowering of respectively one of the nozzles 35, one of the channel brushes 19 and the wide sweep brush 18. Which nozzle 35 and channel brush 19 are controlled depends on which side the vehicle is sweeping.

The lower portion of the panel 130 contains a single switch 150 which is a master change over switch for changing from left to right hand sweeping and vice versa. This switch simultaneously causes one nozzle 35 to be raised and the other lowered, one channel brush 19 to be raised and the other lowered and the wide sweep brush to be pivoted from one side to the other. The switch 150 also switches off one set of water spray nozzles and switches on the other. Thus all the necessary actions for changing over from one side sweeping to the other with the exception of the flaps 53 are controlled by a single switch 150. The control of the flaps 53 is retained independently by switches 134, 136.

Figure 12:
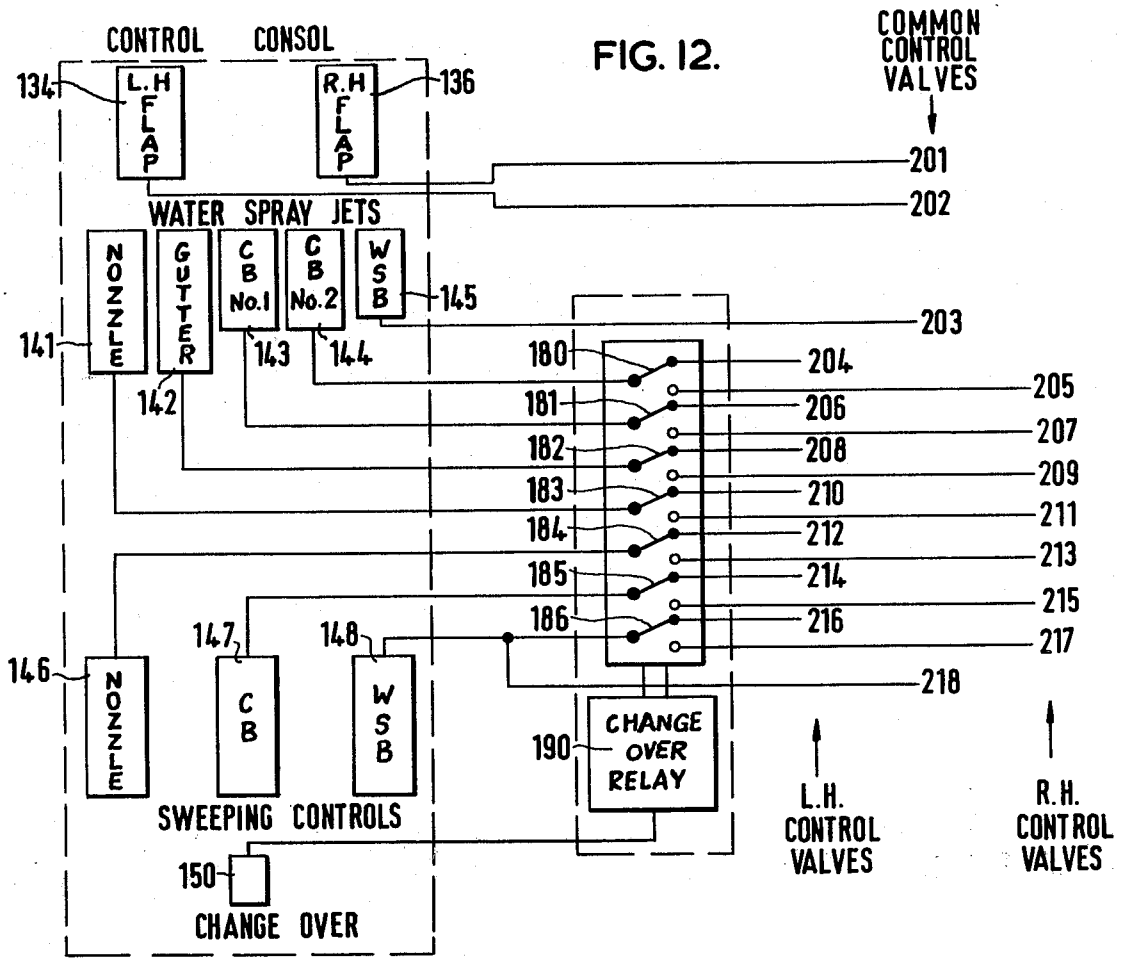
FIG. 12 shows schematically the electrical control circuit.
Figure 13:
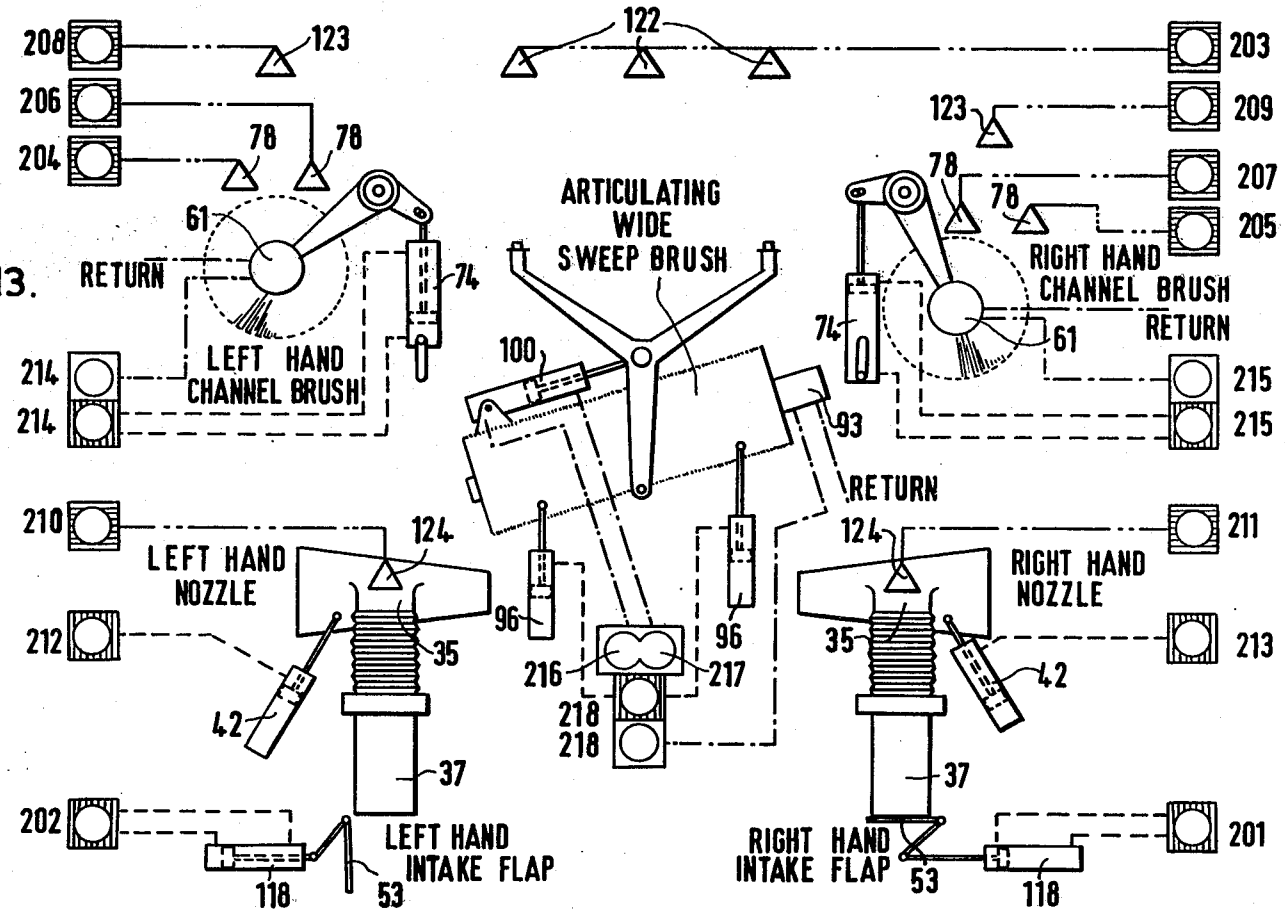
FIG. 13 shows schematically the fluid control circuit.

The connection of switches 134, 136, 141–148 and 150 to their respective rams, nozzles, etc. is illustrated schematically in FIGS. 12 and 13. It will be observed that FIG. 12 shows the connection of the above switches to their respective valves and FIG. 13 shows the connection of said valves to the respective rams, nozzles, etc.

Thus, switch 134 is connected to a pneumatic valve 202 which controls the left hand ram 118 and hence the left hand flap 53. Similarly switch 136 is connected to a valve 201 to control the right hand flap.

Switch 145 is connected to a water valve 203 which controls spray jets 122. Switch 144 is connected to a switch 180 and thence either to a water valve 204 which controls one of the left-hand nozzles 78 or a water valve 205 which controls one of the right hand nozzles 78. Similarly switch 143 is connected to a switch 181 and thence to either water valve 206 or 207 controlling the other nozzles 78.

Switch 142 is connected to a switch 182 which connects to water valve 208 or water valve 209 for controlling left and right hand gutter jets 123 respectively. Similarly switch 141 is connected to switch 183 which connects to water valve 210 or 211 for controlling left and right hand suction nozzle jets 124 respectively.

Switch 146 is connected to a switch 184 which connects to pneumatic valves 212 or 213. The pneumatic valves 212 and 213 respectively control left and right rams 42 for raising and lowering suction nozzles 35.

Switch 147 is connected to one of a pair of valves 214 or 215 via a switch 185. Each pair of valves 214, 215 comprises a hydraulic valve which controls its respective hydraulic motor 61 and a pneumatic valve which controls its respective ram 74. Thus actuating valve pair 214, for instance, lowers the left hand channel brush 19 and its associated curtain 80 and simultaneously switches on the motor 61 to drive the brush.

Switch 148 is connected via switch 186 to one of valves 216 or 217. Valves 216, 217, which are hydraulic valves, are connected to opposite sides of double acting ram 100 to pivot the wide sweep brush to left or right. Switch 148 is also connected directly to a valve pair 218 comprising a pneumatic valve connected to rams 96 to raise and lower the wide sweep brush and a hydraulic valve connected to motor 93 to drive the wide sweep brush. Thus, actuation of switch 148 lowers the wide sweep brush 18 and simultaneously starts it rotating.

Finally, the master change over switch 150 is connected to a change over relay 190 which is connected to each of the switches 180–186. Thus, actuation of switch 150 causes switches 180–186 to simultaneously change from connection to the even numbered valves 204–216 to the odd numbered valves 205–217 or vice versa. This effects the change from left hand to right hand sweeping as described above.

A further feature of the control system not illustrated in FIGS. 12 and 13 is that the ignition switch 139 for the auxiliary engine is interlocked to the other controls so that turning the ignition switch to the 'off' position automatically raises both channel brushes, both suction nozzles and the wide sweep brush clear of the road surface and simultaneously turns off all water jets.

The operation of the suction road sweeping vehicle described above is as follows. The vehicle is driven in the normal manner by the operator from the cab with the exception that the operator sits in the driving position 131 or 132 on the same side of the vehicle as the side of the road it is intended to sweep. To commence sweeping, the auxiliary engine is started and the sweeping side selected by switch 150. The brushes and suction nozzle are lowered by actuating switches 146, 147, 148 and the water jets are switched on by switches 141 to 145. The flap 53 on the side to be swept is opened and the flap 53 on the opposite side is closed by means of switches 134, 136. Sweeping is then commenced by the operator driving the vehicle in a forward direction with the appropriate channel brush aligned with the gutter.

The water jets help to keep the dust from rising and the dust is loosened from the road surface by the channel brush 19 and wide sweep brush 18. The suction fan applies a suction to the interior of the tipping body 15 via the mesh 50 and ducts 47, 48 and this suction causes the dust loosened by the brushes to be sucked up the nozzle 35 and thence to the interior of the body 15 via inlet 37. The position of the inlet pipe 37 adjacent the front of the body 15 and of the mesh forming the air outlet adjacent the rear of the body spaces them as far apart as possible within practical limits. Furthermore the arrangement of the baffles within the body ensures that air entering the body is diverted and travels through the maximum possible distance between inlet and outlet. This is essential to the efficient operation of the sweeper since the air enters the body at high velocity and its subsequent slowing down and expansion is essential to allow the entrained dust to drop to the floor of the body before the air is sucked out of the outlet to the fan. Moreover, the baffle arrangement ensures that dust entering the body is deposited towards the centre of the body (as shown in FIG. 3) rather than at the opposite side to the inlet as has generally been the case in the past. This prevents a build up of dust over the non-operating inlet and contributes to a more even loading of the vehicle so that greater use of the vehicle is possible before it needs to be emptied.

The flap 53 positioned over the non-operating inlet 37 ensures that no dust ingresses into the inlet so that, when it is desired to change the sweeping side, the operator may readily achieve this without having to dismount from his cab and unblock the inlet pipe.

As has already been mentioned above, the body 15 of the sweeper, the fan housing 16 and certain of the ancillary equipment are mounted on a subframe 23. This subframe is more clearly illustrated in FIGS. 14 to 18. The purpose of the subframe is to provide a support for the parts listed above and the subframe is of a standard size so that it may be readily fitted to any one of a wide range of different chassis. A further advantage of the subframe assembly is that it allows bodies to be built independently of chassis.

The subframe is a one-piece welded assembly comprising two lateral beams 23 joined by a central cross member 220 a rear cross member adjacent the body tip pivot 21 and a front cross member (not shown). The body is pivoted to the subframe by flanges 22 as previously described and, for transit purposes, the body is also bolted to the cross member 220. As is stated above, the subframe is a standard size and includes in its one-piece welded construction the body tip supports 21, the body support cross member 220, a mounting for the body tipping ram, fixings for the inlet duct brackets, pads for the auxiliary engine frame, fixings for lifting beams (to be described below) and mounting for all water, hydraulic and pneumatic valves, rams, etc.

Figure 14:
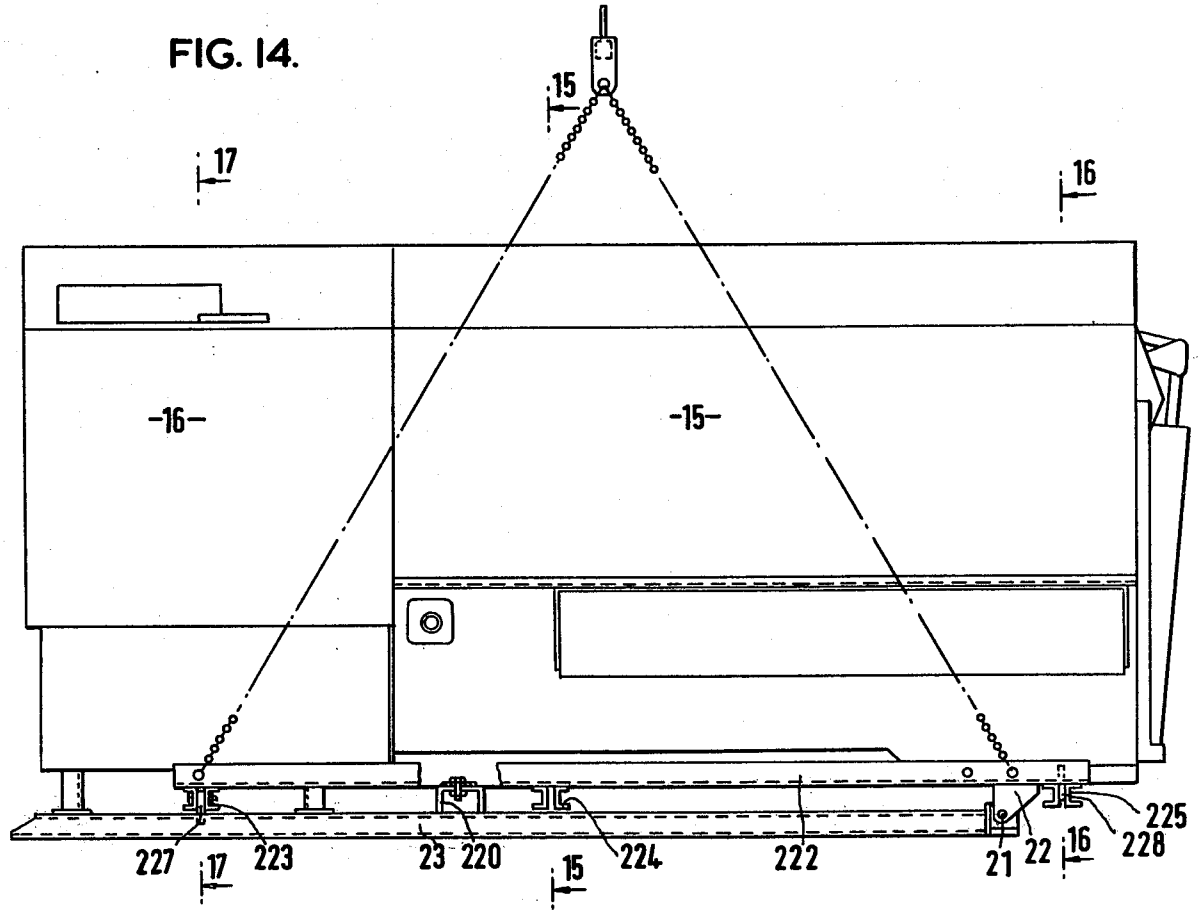
FIG. 14 is a side elevation of the sweeper body when prepared for shipping.
Figure 15:
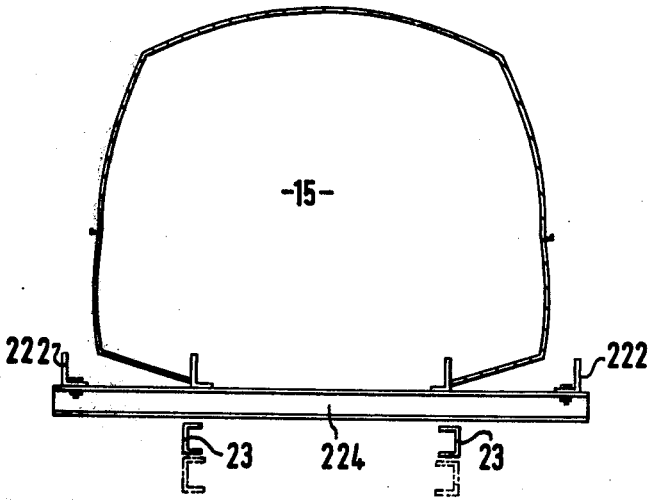
FIG. 15 is a section along the line 15—15 of FIG. 14.
Figure 16:
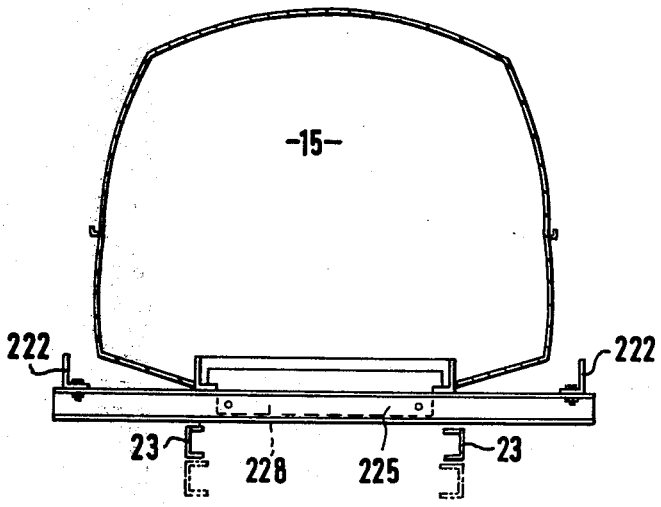
FIG. 16 is a section along the line 16—16 of FIG. 14.
Figure 17:
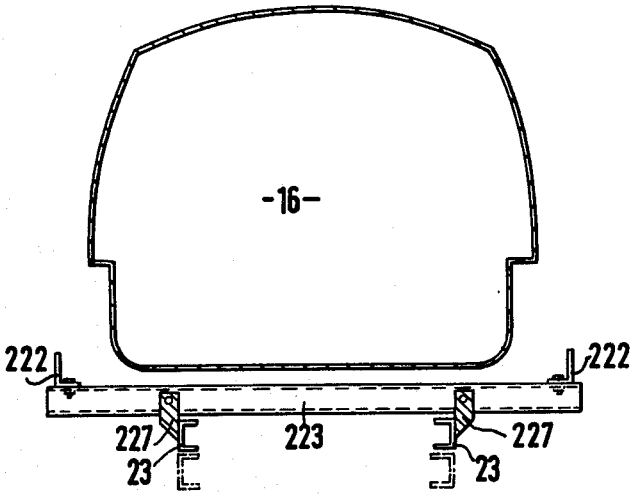
FIG. 17 is a section along the line 17—17 of FIG. 14.
Figure 18:
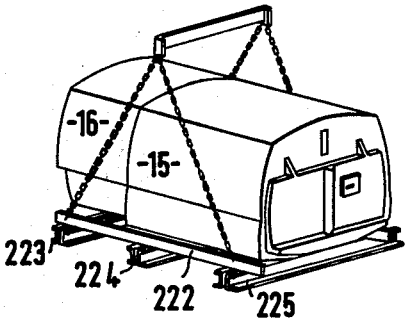
FIG. 18 is a perspective view of the sweeper body and shipping subframe.

When it is desired to transport the assembly comprising the body and subframe, either during assembly in the factory of after assembly for shipment, a skid unit is used. The skid unit comprises two lateral beams 222 joined by three cross members 223, 224, 225. As can be seen in FIG. 14, the cross members fit under the body between the underside of the body and the subframe. The front cross member 223 is attached to the subframe by bolting to brackets 227 and the rear cross member 225 is bolted to a keep plate 228 protruding from the underside of the body. As illustrated in FIGS. 14 and 18, the unit comprising the body 15 and subframe mounted on the skid unit may readily be moved, for example by crane.

The sweeper body assembly is constructed on the skid unit and may be shipped also on the skid unit. When it is desired to mount the assembly on a chassis, the complete assembly may be positioned on the chassis without removing the skid unit. After assembly is completed, the skid unit is removed by unbolting and sliding out the cross members 223, 224, 225. Thus the skid unit provides a convenient support on which the sweeper assembly may be constructed and transported.

It will be realised that the invention is not limited to the preferred embodiment described above and various modifications may be made.

We claim:

1. A vacuum operated refuse collecting vehicle comprising in combination an air-tight container mounted on the chassis of the vehicle and having an outlet communicating with means for generating a vacuum within the container, brush means carried by the vehicle, a suction conduit for each side of the vehicle, each suction conduit extending at one end into the interior of the container and being provided at the other end with a nozzle which may be disposed at a short distance from the ground, and means mounted at said one end of each conduit and operable from outside the container for separately closing off said one end of each suction conduit to prevent refuse entering said one end of the conduit when it is closed, in which said one ends of said suction conduits communicate with the container in positions one on each side of a central longitudinal plane of the container and adjacent one end of the container, said outlet is positioned in the upper part of the container adjacent the other end of the container and continuously curved air-deflector means are provided above said one end of each suction conduit, the arrangement being such that, in use, with one suction conduit open and the other closed, air entering the container through said one of the suction conduits is diverted by the respective air-deflector means up around the upper part of the container and down towards the central lower part of the container before passing out through the outlet, to prevent refuse being deposited on and around said one end of said other suction conduit.

2. A vehicle as claimed in claim 1 in which the air deflector means comprises a curved plate positioned above each suction conduit and a further air deflector plate is provided depending from the upper wall of the container and extending in the central longitudinal plane of the container.

3. A vehicle as claimed in claim 1 in which each closing means comprises a blanking plate pivotable about a longitudinal axis between a closed position in which the blanking plate covers the said one end of its respective suction conduit and an open position in which the blanking plate extends upwardly from the said one end on the side of the suction conduit remote from the central longitudinal plane of the container, the blanking plate in its open position forming further air deflector means.

4. A vehicle as claimed in claim 3 in which means are provided for pivoting each blanking plate between its open and closed positions, said means being operable by remote control from a driver's cab of the vehicle.

5. A vehicle as claimed in claim 4 in which each blanking plate is mounted on an end portion of a shaft extending longitudinally of the vehicle, said end portion being bent relative to the axis of the shaft, and said pivoting means comprises fluid-operated cylinder and piston means connected to a lever rigidly secured on the shaft.

6. A vehicle as claimed in claim 5 in which each blanking plate is connected to its respective shaft end portion by spring clips engaging a part of the plate and extending in grooves on opposite sides of the shaft end portion, the arrangement being such that relative pivotal movement between the plate and the shaft is possible.

7. A vehicle as claimed in claim 1 in which the outlet comprises the open end of a duct extending along the upper wall of the container from said one end and terminating in a flared portion adjacent said other end, the arrangement being such that air entering the container passes out through the gap between said flared portion and a wall of the container forming said other end.

8. A vehicle as claimed in claim 7 in which the gap extends across the full width of the container and the duct communicates with the container through a mesh grid positioned in the gap.

9. A vehicle as claimed in claim 1 in which the suction conduits are positioned adjacent the front end of the container and adjacent the side walls thereof and the outlet is positioned adjacent the rear end of the container.

10. A vehicle as claimed in claim 9 in which the rear end wall of the container includes a door for the egress of refuse, said door having means for hermetically sealing it in relation to the container and the container is pivotally mounted on the chassis for tipping movement about a transverse axis adjacent the rear end of the container, whereby tipping movement of the container is effective to tip refuse out of the container through the rear door.

11. A vehicle as claimed in claim 9 in which the part of each suction conduit communicating with the container comprises a pipe extending into the container and each said pipe is enclosed in a housing extending around said pipe and to the front and side walls of the container thereby to prevent refuse collecting between the pipes and the front corners of the container formed at the junction of said front and side walls.

12. A vehicle as claimed in claim 11 in which each suction conduit includes a flexible part connected at one end to the respective pipe and the other end of which flexible part is supported by a trailer trolley having wheels which engage the ground, in use, and which trolley is connected by a draw bar to a part of the chassis.

13. A vehicle according to claim 12 wherein said draw bar is pivotally connected to the chassis so that it may swing in an up and down direction.

14. A vehicle according to claim 12 wherein remote control means are provided for moving the draw bar and the trolley bodily in an up and down direction so that when not in use the trolley is clear of the ground.

15. A vehicle according to claim 1 wherein said container is provided with an auxiliary inlet opening in which is rotatably mounted a tubular stub shaft which extends into the upper part of the container, the tubular stub shaft having a horizontal extension outside the casing constituting a boom to one end of which is pivoted an auxiliary flexible pipe and the other end of the flexible pipe is formed with a suction nozzle.

16. A vehicle as claimed in claim 1 in which the brush means comprise a rotatable brush for each side of the vehicle, and which may be disposed in contact with the ground in front of the respective nozzle in the normal direction of travel of the vehicle wherein each brush is connected to the vehicle chassis by a respective pivot arm, means mounting the pivot arm for pivotal movement about two mutually perpendicular axes, and fluid-operated cylinder and piston means connected between a part of the vehicle chassis and one end of a cable passing around a pulley and connected at its other end to a part of the pivot arm offset from both pivot axes, said cylinder and piston being operable to move the brush between an operating position in which the brush is in contact with the ground and the pivot arm extends outboard of the vehicle chassis so that the brush extends outside the wheel base of the vehicle and a stowed position in which the brush is raised clear of the ground and the pivot arm is swung inboard so that the brush lies within the plan area delimited by the vehicle.

17. A vehicle as claimed in claim 1 in which each pivot arm comprises a pair of links pivoted at one end to means fixed to the vehicle chassis and at the other end to the brush.

18. A vehicle as claimed in claim 1 in which the brush means comprises a rotatable channel brush on each side of the vehicle, each channel brush being connected by a pivotable linkage to the chassis, and each suction conduit closing means comprises a pivotable closure, the vehicle further comprising moving means for each nozzle for moving the nozzle between an operating position in which the nozzle is disposed at a short distance from the ground and a stowed position in which the nozzle is raised clear of the ground, pivoting means for each channel brush for pivoting the brush between an operating position in which the brush is in contact with the ground and a stowed position in which the brush is raised clear of the ground, and pivoting means for each closure for pivoting the closure between a closure position in which the closure closes off the said one end of its respective suction conduit and an open position, wherein remote control means are provided for operating the nozzle moving means, the channel brush pivoting means and the conduit closure pivoting means, said remote control means including controls for operating all said moving and pivoting means separately and a master control for operating the nozzle moving means and the brush pivoting means simultaneously to move one nozzle from its operating position to its stowed position, move the other nozzle from its stowed position to its operating position, move one channel brush from its operating position to its stowed position and move the other channel brush from its stowed position to its operating position.

19. A vehicle as claimed in claim 18 in which the nozzle moving means, channel brush pivoting means and suction conduit closure pivoting means each comprise fluid-operated cylinder and piston means.

* * * * *